US007083048B2

(12) United States Patent
Taylor et al.

(10) Patent No.: US 7,083,048 B2
(45) Date of Patent: Aug. 1, 2006

(54) DISPLAY ASSEMBLY

(75) Inventors: Barbara Marcos Taylor, River Vale, NJ (US); Frank Pizzitola, Streamwood, IL (US)

(73) Assignee: Kraft Foods Holdings, Inc., Northfield, IL (US)

( * ) Notice: Subject to any disclaimer, the term of this patent is extended or adjusted under 35 U.S.C. 154(b) by 194 days.

(21) Appl. No.: 10/449,489

(22) Filed: May 30, 2003

(65) Prior Publication Data

US 2005/0000852 A1 Jan. 6, 2005

(51) Int. Cl.

| | |
|---|---|
| ***B65D 1/22*** | (2006.01) |
| ***B65D 5/50*** | (2006.01) |
| ***B65D 43/08*** | (2006.01) |
| ***A24F 27/00*** | (2006.01) |

(52) U.S. Cl. ..... 206/745; 206/736; 206/775; 229/125.19

(58) Field of Classification Search ..... 206/745, 206/736, 775; 220/779, 800, 8; 229/125.19, 229/125.33, 164, 120.24
See application file for complete search history.

(56) References Cited

U.S. PATENT DOCUMENTS

| | | | | |
|---|---|---|---|---|
| 3,684,158 | A * | 8/1972 | Harris | 229/221 |
| 3,951,329 | A * | 4/1976 | Turner | 229/125.32 |
| 3,955,671 | A | 5/1976 | Ockey | |
| 4,053,101 | A | 10/1977 | Hart, Jr. | |
| 4,184,625 | A * | 1/1980 | Stollberg et al. | 206/521.1 |
| 4,342,416 | A * | 8/1982 | Philips | 229/122.32 |
| 4,362,265 | A * | 12/1982 | Williams | 229/125.19 |
| 4,383,636 | A * | 5/1983 | Chaffers | 206/509 |
| 4,742,917 | A * | 5/1988 | Bornwasser et al. | 229/120.011 |
| 5,076,491 | A * | 12/1991 | Freudentahl et al. | 229/117.16 |
| 5,195,677 | A * | 3/1993 | Quintana et al. | 229/117.07 |
| 5,277,360 | A | 1/1994 | DeMott | |
| 5,839,651 | A * | 11/1998 | Teags et al. | 229/125.32 |
| 6,000,849 | A * | 12/1999 | Keller et al. | 383/80 |
| 6,027,017 | A | 2/2000 | Kuhn et al. | |
| 6,135,289 | A | 10/2000 | Miller | |
| 6,371,365 | B1 | 4/2002 | Doucette et al. | |
| 6,435,351 | B1 | 8/2002 | Gibb | |
| 6,457,637 | B1 | 10/2002 | Fritz et al. | |
| 6,478,159 | B1 | 11/2002 | Taylor et al. | |
| 2002/0043554 | A1 | 4/2002 | White et al. | |

FOREIGN PATENT DOCUMENTS

| | | |
|---|---|---|
| FR | 2 653 409 A1 | 4/1991 |
| GB | 2 162 819 A | 2/1986 |
| GB | 2 220 406 A | 1/1990 |

* cited by examiner

*Primary Examiner*—Faye Francis
(74) *Attorney, Agent, or Firm*—Fitch, Even, Tabin & Flannery

(57) ABSTRACT

An assembly for shipping and retail includes a tray supporting products and a removable cover. The tray includes a bottom wall, a front wall, a rear wall, a pair of side walls, and dividers. The cover includes a top panel, a front panel, and a rear panel, and a portion of each of the front and back panels contacts the bottom wall of the tray. The rear panel has rear members separated by a space. The top panel is sized not to exceed the outer dimensions of the tray, and portions thereof may be supported by the side walls. The assemblies are capable of supporting the compression loads due to stacking with the loads being transmitted through the walls and dividers of the cover and tray. The lateral edges of the front and rear panels of the cover are sized to prevent lateral displacement of the cover.

2 Claims, 3 Drawing Sheets

1/3
10
12
14
20
22
23
24
26
40
42
44
46
50
52
54
60
79
80
82
92
100
120
130

60
70
82
92
120
130

DISPLAY ASSEMBLY

BACKGROUND

The invention relates to a display assembly, and more particularly to a carton comprising a display tray and a cover capable of supporting stacking loads.

In recent years, display shippers have enjoyed increased popularity due to the economies that may be realized by including a display tray as part of a shipping carton. When the display shipper arrives at its destination, the cover may be removed, and the tray can then be used in the store to display products for retail sale without the need to remove the products from the tray.

It is, of course, desirable that a display shipper be lightweight, but it must also be strong enough to support loads associated with stacking a plurality of shipping containers on a pallet, constraining the containers to secure them in place on the pallet, and transporting the palletized containers from distribution points to retail locations. The loads that a display shipper must support may vary, and the height of a commercial pallet load is generally variable depending on the product being shipped. Products that are heavy and/or fragile are generally stacked to a lower height, while products that are light or less susceptible to damage may be stacked higher.

It is also generally desirable that the shipping container not occupy more space than necessary. Any space occupied by the shipping container reduces the amount of space available for product on the pallet.

In the past, shipping container covers have often comprised a simple box structure comprising a rectangular, horizontal top wall, and four vertical walls extending downward therefrom. This type of cover may be readily placed over a display tray or other container bottom, and secured thereto by tape at the bottom. While this type of cover is widely used, it has significant drawbacks from the standpoint that each of the vertical walls is disposed outside of the footprint of the display tray, and accordingly the cover adds not only to the vertical dimension, but also to the length and width of the shipping container. Also, if the cover is secured to the tray by tape at the bottom, the assembly generally must be lifted to cut the tape efficiently. Accordingly, while this type of cover may be preferred for certain applications due to its strength and rigidity, for other products, particularly lightweight products, it is less than ideal.

There is a need for an improved display assembly, and in particular, for an improved cover for retail display assemblies.

SUMMARY

The invention provides a novel and improved display shipper assembly comprising a removable cover that interfits uniquely with the tray to provide sufficient strength and rigidity to withstand forces associated with stacking, shipping and handling of commercial pallet loads of the assemblies. The cover preferably does not extend significantly beyond the footprint of the tray. More particularly, the cover preferably does not include walls or panels overlying the exteriors of the front, back or side walls of the tray.

The tray may comprise a bottom wall, a front wall extending upward therefrom and having a height less than that of the products, a full height rear wall opposite the front wall, and a pair of full height side walls. The rear wall of the tray may have a double thickness central portion formed by folding an inner rear wall portion inward over the top of an outer rear wall portion, and single thickness end portions on each side of the central portion. A pair of dividers may be folded inward from opposite ends of the double thickness central portion of the rear wall. Each of the dividers may have a horizontal upper edge at the same elevation as the upper edge of the rear wall, and a forward edge spaced from the front wall by a predetermined dimension less than the depth of one of the products. Each of the side walls of the tray may include an upper edge having a horizontal rear portion at the same elevation as the upper edge of the rear wall and an angled front portion sloping downward and forward to the front wall. The side walls are preferably joined to the front wall along its entire height at the front corners of the tray.

To provide support for stacking on the assembly, the cover preferably includes a top wall that overlies upper edges of the side walls of the tray so as to be supported thereby, and one or more vertical walls or panels extending downward from the top wall to the bottom wall of the tray so as to be supported by the bottom wall of the tray. This enables the vertical walls or panels to transmit compression loads from the top wall of the cover to the bottom wall of the tray without unacceptable compression loads being imposed on the product.

The cover may comprise a top wall, a front wall extending downward therefrom, and one or more rear wall panels opposite the front wall. The front wall of the cover preferably extends downward to contact the bottom wall of the tray between the front wall of the tray and the products, and between the front wall and the forward edges of the dividers. The rear wall panels preferably extend downward from the top wall to contact the bottom wall of the tray on both sides of the double thickness central portion of the rear wall of the tray, with a slot between the panels. The slot may extend upward to the top wall and may have a width equal to the spacing between the panels. Each of the rear wall panels may be generally rectangular and have beveled lower corners.

The top wall of the cover preferably has a width greater than that of the front and rear walls of the cover, such that the top wall overlies the upper edges of the side walls of the tray so as to be supported thereby. The top wall preferably has a generally rectangular configuration with beveled front and rear corners. The cover preferably interfits with the tray so that the weight of the plurality of retail display assemblies stacked thereon results in compression loads on the side walls, rear wall and dividers of the tray, and on the front, rear and top walls of the cover.

The cover preferably has a width less than or equal to the width of the tray. Triangular side openings are defined between the cover and the angled forward portion of the top edge of the side walls of the tray.

Each of the rear wall panels of the cover preferably has an outer edge in contact with a respective one of the side walls of the tray, and an inner edge spaced from an adjacent one of the dividers to facilitate insertion of the rear wall panels between respective dividers and side walls of the tray while constraining the cover against lateral movement after insertion.

The cover is preferably secured to upper portions of one or more of the front, rear and/or side walls of the tray by tape, which enables the tape to be cut without lifting the assembly.

Each of the side walls of the tray preferably comprises an outer portion folded up from the bottom wall, one or more inner portions joined to the outer portion at a fold along the top and extending down to the bottom wall, and a middle portion folded forward from an end of the rear wail and sandwiched between the inner and outer portions. The middle portion is preferably substantially coextensive with the horizontal top edge of the side wall, so that the rear portion of the side wall has a three ply construction. That is, the rear portion of each side wall has three times the thickness of the single thickness portions of the tray such as the bottom wall and the central portion of the rear wall.

DETAILED DESCRIPTION OF THE PREFERRED EMBODIMENTS

Figure 1:
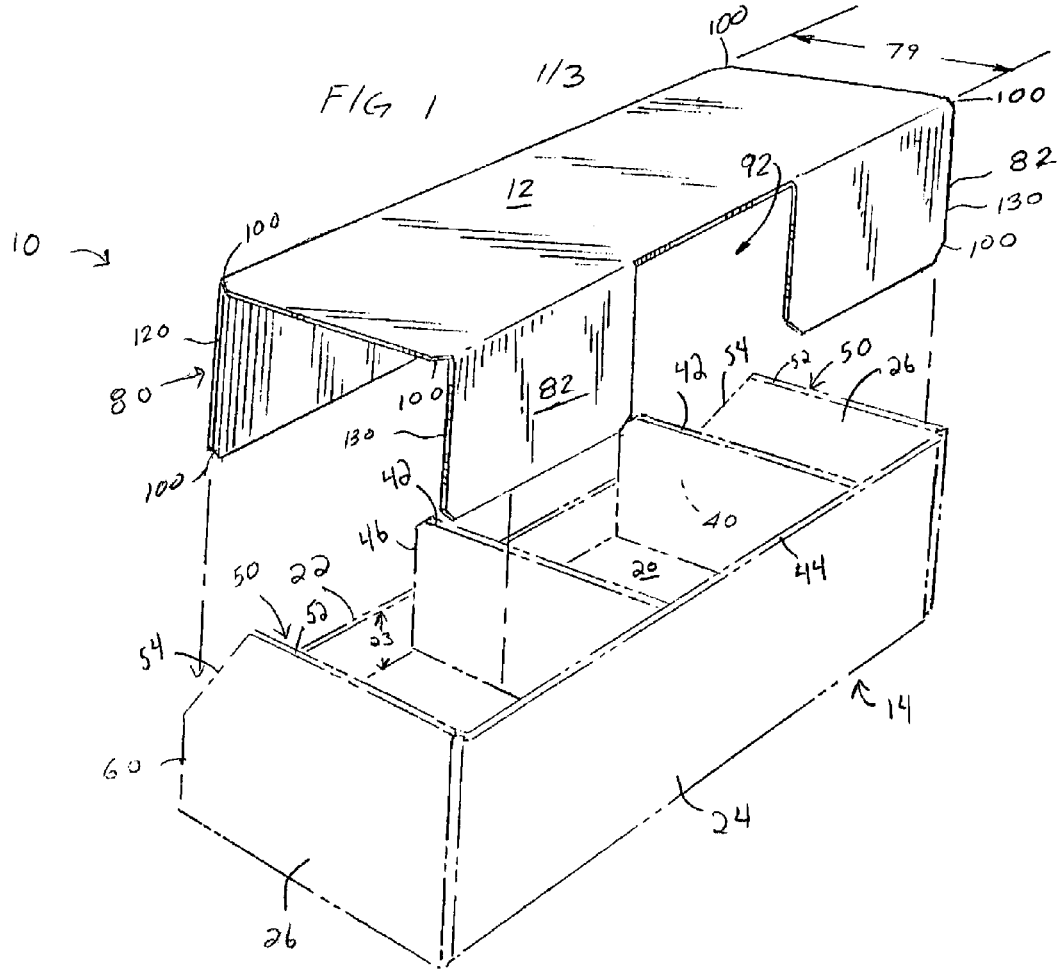
FIG. 1 is an exploded perspective view of a display tray and cover in accordance with an embodiment of the invention.
Figure 2:
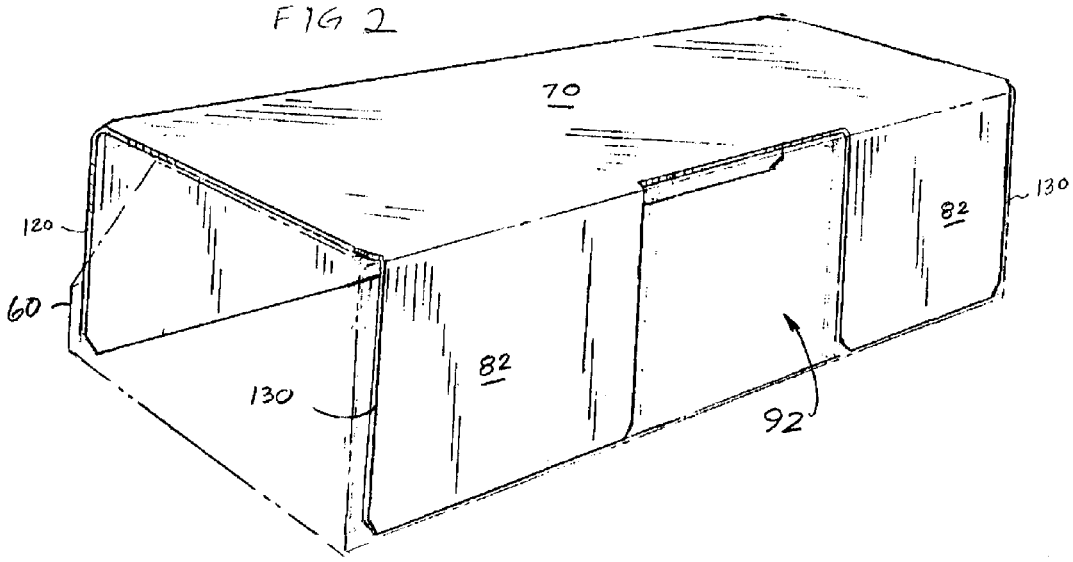
FIG. 2 is a perspective view of the cover, with the display tray shown in fantum in assembled position with a cover.
Figure 3:
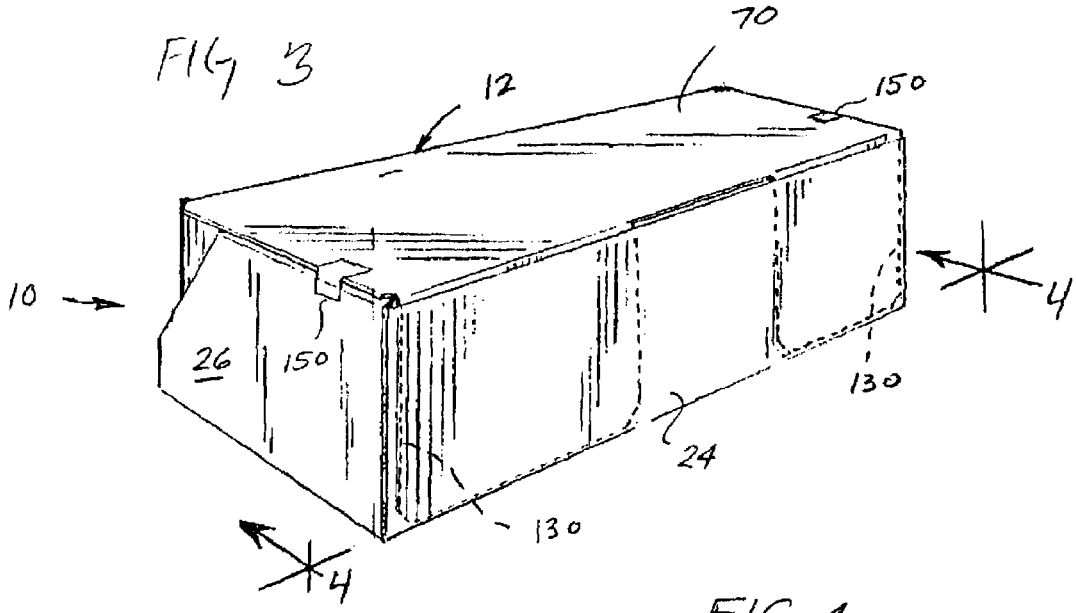
FIG. 3 is a perspective view of the display tray and cover in assembled configuration, with portions of the display with portions of the cover shown in fantum.

Referring to the Figs., a product shipper/display assembly 10 is depicted comprising a removable cover 12 fit into a tray 14 such that the assembly is capable of withstanding forces associated with stacking, shipping, and handling a plurality of the assemblies 10 containing product (FIG. 9) as a commercial pallet load. The cover is preferably secured to upper portions of one or more of the front, rear and/or side walls of the tray by tape 150, which enables the tape to be cut without lifting the assembly.

The assembly 10 includes the tray 14 and the cover 12 such that the footprint of the assembly 10 is dependent entirely on the geometry and size of the tray 14. In order to achieve this, the cover 12 inserted in the tray 14 does not extend significantly beyond the footprint of the tray. That is, the width and depth of the cover 12 are preferably equal to or less than the respective outer width and depth of the tray 14. If the cover extends beyond the width or depth of the tray, it preferably extends beyond by a distance less than the thickness of the cover materials.

Figure 9:
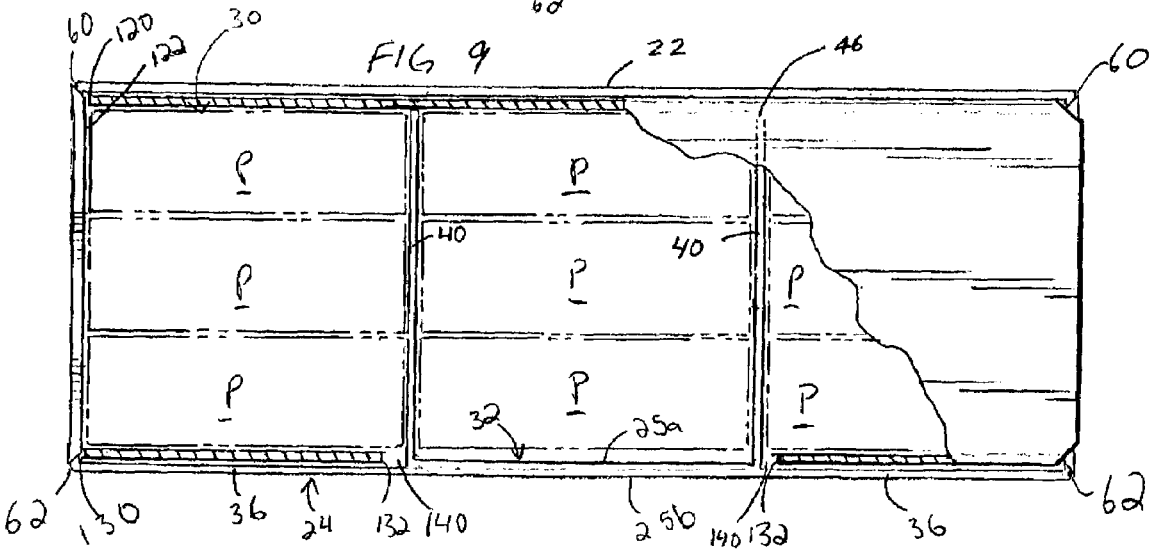
FIG. 9 is a plan view of the assembly, with portions of the top wall of the cover broken away and portions of the front and rear panels shown in section.

The tray 14 has sides including a bottom wall 20, a front wall 22, a rear wall 24, and a pair of side walls 26 defining an interior space in which product or products P (FIG. 9) are located for shipping and retail display. The illustrated products P each have a height, a width, and a depth, and are arranged in rows, as depicted in FIG. 9. The front wall 22, rear wall 24, and side walls 26 extend generally upward from the bottom wall 20. The front wall 22 has a height less than that of the products P so that a front face 30 of the products P (FIG. 9) is visible to a consumer when the cover 12 is removed for display. The rear wall 24 and the side walls 26 each have at least a portion with a height equal to or greater than the height of the products P.

Figure 5:
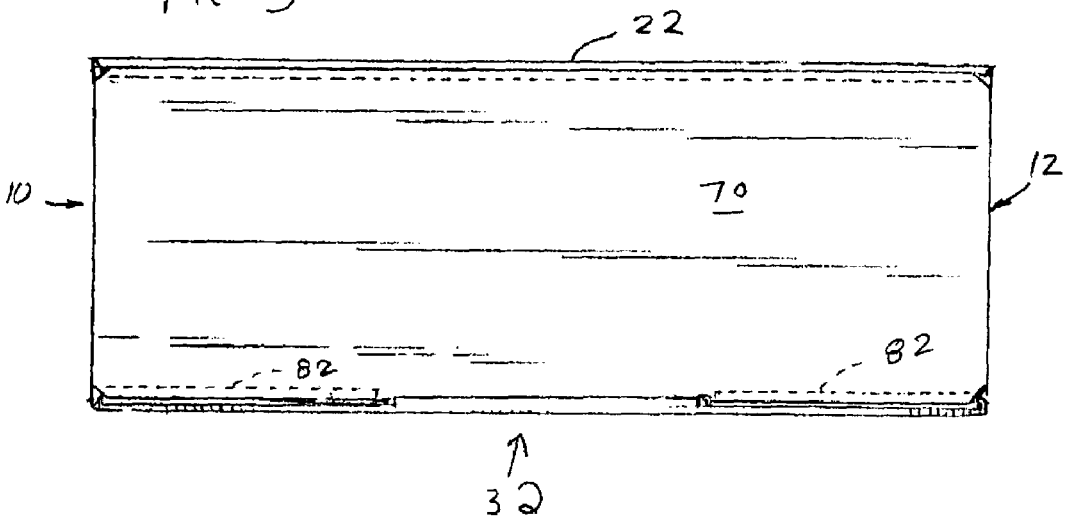
FIG. 5 is a plan view of the assembly of FIG. 3.
Figure 6:
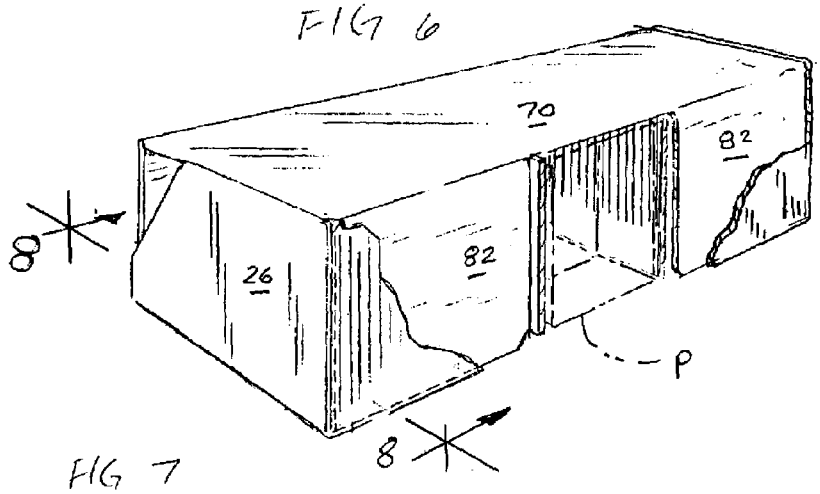
FIG. 6 is a perspective view of the assembly of FIG. 3 with portions of the tray broken away, and with one of the products contained in the display tray shown in fantum.
Figure 7:
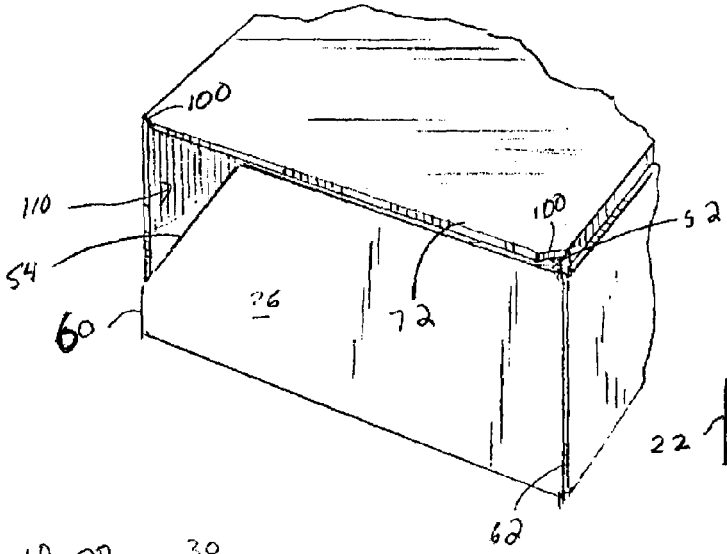
FIG. 7 is a fragmentary view of a portion of the assembly.

In the illustrated embodiment, a portion of the rear wall 24 of the tray 14 is formed by folding over on itself a portion of the material. Referring to FIGS. 5 and 9, this provides a center region 32 of the rear wall 24, with a double thickness and forms inner and outer rear wall portions 25*a* and 25*b*, respectively. A pair of dividers 40 are folded orthogonally inward from the inner rear wall portion 25*a* such that rear wall regions 36 on each side of the center region 32 or central portion have a single thickness.

Each of the dividers 40 preferably has a horizontal upper edge 42 at an elevation equal to that of the upper edge 44 of the rear wall 24. Each of the dividers 40 also has a forward edge 46 spaced a predetermined distance from the front wall 22. The predetermined distance is preferably slightly greater than the thickness of the front wall of the cover 12 to allow the front wall of the cover to fit between the forward edge 46 and the front wall 22 of the tray. The predetermined distance may be e.g., between ⅛ in. and ½ in., less than the depth of one of the products P, to prevent the products from shifting laterally through the space between the front wall 22 and the forward edge 46 of any of the dividers 40.

As stated above, each of the side walls 26 includes a full-height portion 50 with an upper horizontal edge 52, and an angled front portion 54 sloping downward from the top edge 52 and forward to the front wall 22. The side walls 26 are preferably joined to the front wall 22 along the entire height of the front wall 22 where the side walls 26 meet the front wall 22 at front corners 60 of the tray 14. Similarly, the side walls 26 are joined to the rear wall 24 at rear corners 62 of the tray 14.

As discussed above, a plurality of assemblies 10 may be arranged and stacked on a pallet to form a palletized load. The load may be shrink-wrapped or otherwise constrained for shipping. To support such stacking of assemblies 10, the cover 12 and tray 14 are utilized to protect the products P.

The illustrated cover 12 includes a top wall 70 that rests atop the tray 14. The cover 12 is preferably made of a lightweight material such as corrugated cardboard or paperboard. The top wall 70 contacts the dividers 40 such that stacking loads, e.g., the weight assemblies supported on the top wall, is transferred from the top wall 70 through the dividers 40 to the bottom wall 20 of the tray 14. Additionally, the width of the top wall 70 is greater than the internal width of the interior space of the tray 14. The additional width of the top wall 70 allows portions 72 of the top wall 70 to overlap the upper edges 52 of the side walls 26 so as to be supported thereby. However, the width and depth of the top wall 70 are preferably less than or equal to the respective outer dimensions of the tray 14 so as not to increase the footprint of the assembly 10 beyond that of the tray 14.

The cover 12 preferably includes a front wall 80 and one or more rear wall panels 82, each foldably attached to the top wall 70 and having beveled lower corners 100. The beveled corners 100 assist in insertion of the cover 12. The front panel 80 extends downward from the top wall 70 and is inserted between the products P and the front wall 22, as well as between the dividers 40 and the front wall 22. Each rear panel 82 extends downward from the top wall 70 opposite the front panel 80 and is inserted between the products P and the rear wall 24. The front and rear panels 80, 82 are generally vertical or otherwise oriented so that loads on the top wall 70 and/or on the front and rear panels 80, 82, are transmitted to the bottom wall 20 of the tray 14. Accordingly, the front panel 80 and rear panel 82 extend downward to contact the bottom wall 20 of the tray 14.

Figure 4:
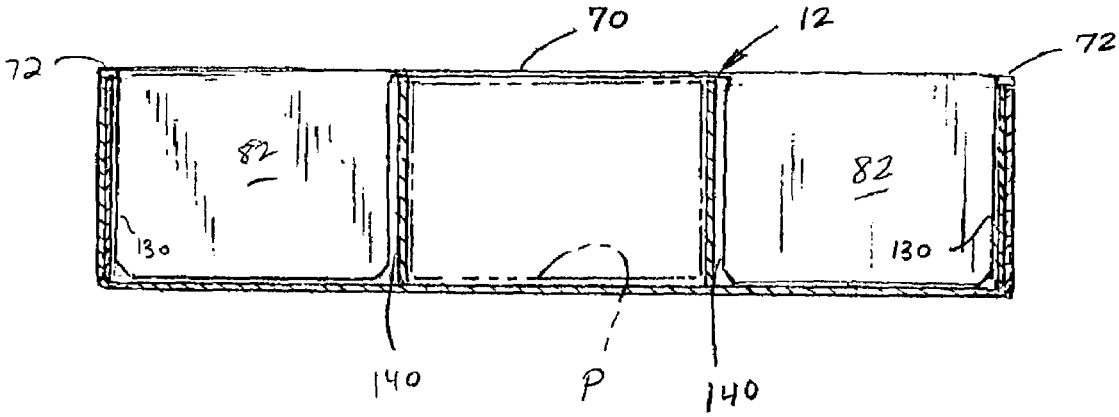
FIG. 4 is a sectional view taken substantially along line 4—4 in FIG. 3.
Figure 8:
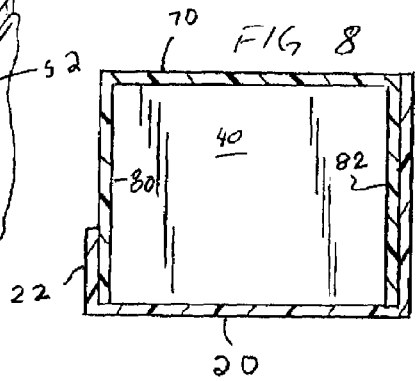
FIG. 8 is a sectional view taken substantially along line 8—8 in FIG. 6.

As shown in FIGS. 4 and 8, two rear panels 82 extend downward from the top wall 70 and contact the bottom wall 20 of the tray 14. The rear panels 82 are formed with a space 92 between them extending upward to the top wall 70. The dividers 40 join the rear wall 24 in the space 92 between the rear panels 82. The rear wall 24 of the tray 14 provides the above-described double thickness in the central region 32, and the combination of the rear wall panels 82 with the regions 36 of the rear wall 24 on each side of the central region 32 provides a full height double wall across the full width of the assembly, except at narrrow gaps provided to facilitate assembly as discussed below. Each of the rear panels 82 is generally rectangular. In each assembly, the cover 12 cooperates with the tray 14 so that compression loads due to weight of articles such as other assemblies stacked thereon is transmitted downward through the side walls 26, rear wall 24, and dividers 40 of the tray 14, and through the front panel 80 and rear panel 82 of the cover 12.

To enable the front and rear panels 80, 82 of the cover 12 to be inserted between the side walls 26 of the tray 14, the outer edges of the front and rear panels 80, 82 are inwardly offset relative to the edges of the top wall. The rectangular top wall 70 has four beveled corners 100.

When the cover 12 is inserted in the tray 14, triangular side openings 110 are defined by the cover 12 and the angled front portion 54 of the side walls 26. These openings provide a convenient location for a user to grasp the cover 12 for removal from the tray 14. In addition, the triangular side openings 110 also enable convenient visual inspection of the products P located within the assembly 10 without removal of the cover.

To prevent lateral movement of the cover 12 relative to the tray 14, lateral edges 120 of the front panel 80 preferably contact the interior surfaces 122 of the side walls 26, and outside lateral edges 130 of the rear panels 82 contact the interior surfaces 122 of the side walls 26. As the cover 12 is sufficiently constrained by the lateral edges 120, 130 of the front and rear panels 80, 82, respectively, it is not necessary for inner edges 132 of the rear members 90 to contact the dividers 40. To facilitate insertion and removal of the cover 12, the space 92 between the rear panels is sized so that a gap 140 is located between each of the inner edges 132 of the rear panels and the adjacent divider 40 (FIGS. 4 and 9).

The tray and cover are preferably made from corrugated paperboard material having a thickness of about ⅛ in., i.e., between 1/16 and 3/16 in. The cover is foldable at the juncture of the front wall and top wall, and at the juncture of the top wall and the rear wall panels, so that the cover may be stored flat in a stack, and folded to the illustrated configuration for use.

While the invention has been described with respect to specific examples including presently preferred modes of carrying out the invention, those skilled in the art will appreciate that there are numerous variations and permutations of the above described embodiments. The invention is not limited to the embodiments described above, and is further described in the following claims:

What is claimed is:

1. In combination with a display tray with an interior space bounded by a bottom wall, a pair of lateral sides each having a top edge, a rear side, and a front side, a cover comprising:

a top panel;

a front panel foldably attached to the top panel and inserted within the front side of the display tray; and a back panel foldably attached to the top panel and inserted within the rear side of the display tray, wherein at least one of the back panel and the front panel contacts the bottom wall, the top panel has a width greater than a width of the front panel and a width of the back panel, and ends of the top panel extend over and are supported by the lateral sides, wherein the top panel has beveled corners spanning from the ends of the top panel to the front panel and the back panel.

2. A display assembly comprising:

a plurality of products, each of said products having a height, a width and a depth;

a tray supporting said products in rows; and a removable cover;

said tray comprising a bottom wall, a front wall extending upward therefrom and having a height less than that of said products, a rear wall opposite said front wall and a pair of side walls;

said rear wall of said tray having a double thickness central portion and single thickness end portions on each side of said central portion;

each of said side walls having an upper edge having a horizontal rear portion at the same elevation as the upper edge of said rear wall and an angled front portion sloping downward and forward and joined to said front wall;

said tray further comprising a plurality of dividers extending forward from the rear wall between rows of the plurality of products and joined integrally to the rear wall by folds, each of said dividers having a horizontal upper edge at the same elevation as the upper edge of said rear wall, and having a forward edge spaced from said front wall by a predetermined dimension less than the depth of one of said products;

said cover comprising a top wall, a front wall extending downward therefrom and contacting said bottom wall of said fray between said front wall and said products, and between said front wall and the forward edges of said dividers, and a plurality of separate rear wall panels extending downward from said top wall to contact the bottom wall of said tray on both sides of said double thickness central portion of said rear wall of said tray;

each of said rear wall panels being generally rectangular and having beveled lower corners; said top wall of said cover having a width greater than that of said front and rear walls of said cover, said top wall overlying the upper edges of the side walls of said tray and being supported thereby;

said top wall being generally rectangular and having beveled front and rear corners;

said cover transmitting compression loads from its top wall to the bottom wall of said tray;

said cover having a width less than or equal to the width of said tray; said tray; said cover defining triangular side openings between the top wall of said cover and the angled forward portion of the top edge of the side walls of the tray;

each of said rear wall panels of said cover having an outer edge in contact with a respective one of the side walls of said tray, and an inner edge spaced from an adjacent one of said dividers to facilitate insertion of said rear wall panels between respective dividers and side walls of said tray while constraining said cover against lateral movement after insertion;

said cover being taped to said tray at locations above the bottom wall of the tray.

* * * * *

UNITED STATES PATENT AND TRADEMARK OFFICE

CERTIFICATE OF CORRECTION

PATENT NO. : 7,083,048 B2
APPLICATION NO. : 10/449489
DATED : August 1, 2006
INVENTOR(S) : Taylor et al.

It is certified that error appears in the above-identified patent and that said Letters Patent is hereby corrected as shown below:

-In column 6, line 14, claim 2, after “wall”, insert -- , --.

-In column 6, line 34, claim 2, delete “fray”, and insert -- tray --.

-In column 6, line 52, claim 2, after “said tray;” delete “said tray;”.

Signed and Sealed this

Twenty-eighth Day of November, 2006

JON W. DUDAS
*Director of the United States Patent and Trademark Office*